US007784320B1

(12) United States Patent
Brown et al.

(10) Patent No.: US 7,784,320 B1
(45) Date of Patent: Aug. 31, 2010

(54) DOORJAMB CLAD MACHINE

(76) Inventors: Duane A. Brown, 1418 Plum St., Cheyenne, WY (US) 82007; Kathleen M. Brown, 1418 Plum St., Cheyenne, WY (US) 82007

( * ) Notice: Subject to any disclaimer, the term of this patent is extended or adjusted under 35 U.S.C. 154(b) by 730 days.

(21) Appl. No.: 11/672,812

(22) Filed: Feb. 8, 2007

Related U.S. Application Data

(60) Provisional application No. 60/771,709, filed on Feb. 9, 2006.

(51) Int. Cl.
*B21B 15/00* (2006.01)
*B21F 11/00* (2006.01)

(52) U.S. Cl. ..... 72/177; 72/129

(58) Field of Classification Search ..... 72/166–182, 72/129, 130, 185, 186, 250; 29/897.3–897.32
See application file for complete search history.

(56) References Cited

U.S. PATENT DOCUMENTS 4,056,962 A 11/1977 Gerhardt
4,173,313 A * 11/1979 Rogers ..... 242/525.4
4,201,352 A * 5/1980 Madachy ..... 242/419.4
4,347,723 A * 9/1982 Bradlee ..... 72/130
4,526,024 A * 7/1985 Toti ..... 72/177
4,660,399 A * 4/1987 Suter et al. ..... 72/181
4,899,566 A * 2/1990 Knudson ..... 72/129
5,018,263 A * 5/1991 Stern ..... 29/469.5
5,295,292 A * 3/1994 Leopold ..... 29/417
5,361,476 A * 11/1994 Leopold ..... 29/417
5,394,722 A * 3/1995 Meyer ..... 72/129
5,628,114 A * 5/1997 Stern ..... 29/897.312
6,151,943 A 11/2000 Nihei et al.
6,360,420 B2 * 3/2002 Shah et al. ..... 29/458
7,610,681 B2 * 11/2009 Calcei et al. ..... 29/897.3
2007/0095120 A1 * 5/2007 Gorski et al. ..... 72/176

* cited by examiner

*Primary Examiner*—Dana Ross
*Assistant Examiner*—Mohammad Yusuf
(74) *Attorney, Agent, or Firm*—Patent Law Office of Rick Martin, P.C.; Rick Martin

(57) ABSTRACT

Aluminum coils of pre-printed metal are pre-cut to lengths and angles to fit a wooden door jamb. Then, a rolling machine accepts a chosen width of sheet metal and rolls out a cladding strip. The strips require only a minimal manual bend of an end tab. The strips can be packaged in the wooden door jamb for field installation onto the wooden door jamb.

1 Claim, 14 Drawing Sheets

DOORJAMB CLAD MACHINE

CROSS REFERENCE APPLICATIONS

This application is a non-provisional application claiming the benefits of provisional application No. 60/771,709 filed Feb. 9, 2006.

FIELD OF INVENTION

The present invention relates to a sheet metal bending machine that produces cladding strips that snap onto a wooden door jamb.

BACKGROUND OF THE INVENTION

U.S. Pat. No. 6,604,334 (2003) to Rochman discloses metal cladding strips to protect the left, right, and header frame members of a door jamb. The preferred metal is a hot dip galvanized steel, 26 gauge. The steel is painted and may have a wood grain pattern. The strips snap onto the wooden frame members. The cladding strips are made by a unitarily roll formed method from a one-piece stock. Next, the pre-formed cladding strips are cut at 45° angles to conform to the upper left and right mitered joints of the wooden door jamb (see col. 6, lines 15 et seq.). Then, the left, right, and upper cladding strips are frictionally snapped onto their respective door jamb members.

What is needed in the art is a roller machine and cutting process that can easily produce various width cladding strips. The present invention provides a pre-rolling cut method and an automated unitary rolling machine that is easily modified to handle various widths of cladding strips.

SUMMARY OF THE INVENTION

An aspect of the present invention is to provide a cutting operation for flat sheet metal pieces.

Another aspect of the present invention is to provide a multi-width sheet metal entry port for a roller machine.

Another aspect of the present invention is to provide a series of rollers driven by an electric motor so as to bend cladding strips at a relatively high speed.

Another aspect of the present invention is to minimize any manual bending step to a quick bending of an end piece using multiple pliers.

Door companies have good warranties on their residential entry doors. Warranties vary from five years to a lifetime. But they only put a one-year warranty on the wooden doorframes. The doorframes are made of wood because it's inexpensive, durable and a good insulator from the elements.

The frames need not be maintained (painted and sealed). If not maintained, wood rot and insects can require that the frame be replaced. Some door manufacturers have aluminum cladding on their door jambs or use all metal door jambs, but the costs are higher than wood door jambs.

Door manufacturers are trying different techniques, such as Peachtree's™ non-porous polymer jamb riser, Masonite's™ paint system, and EverGuard's™ ⅛ inch PVC cap glued directly to the wood jambs. With a custom bending machine, one can use cheap wooden door jambs, cover up all dents, splits, nail holes, screw holes, and protect from insects and elements by simply snapping on a PVC aluminum pre-formed and pre-cut covering (with no tools needed to install).

The present invention starts with a box of aluminum trim coil (24"×50' roll) preferably from Rollex™. The Full roll of coil is put in a roller cradle and pulled out into a metal slitter, which cuts down the coil into two sections of approximately 7⅜" and one section of approximately 9⅜". Each section is cut down to 7' lengths (the 7⅜" pieces are for 2×4 thickness door jambs and the 9 ⅜" pieces are for 2×6 thickness door jambs). The pieces go to the cutting table, where a custom designed press punch cuts out the top angles and the bottom angles to the lengths needed for the sides and top of the door jambs. Then, the pieces are put through the custom bending machine. This machine forms the metal to the size to fit over door jambs. Then, the formed pieces are taken to the packaging table where the ends on the top sides are bent out to form tabs. Then, one left side, one right side and one top are put between 30 pound medium lightweight brown kraft 12" wide paper and are banded together with 80 gauge 2" wide clear banding film. On the top and bottom are cardboard tabs bonded to the metal wraps (coverings) to be used by the door manufacturers to secure to entry doors for transit. A flyer of the product is banded to the coverings with the company's name, phone number, color sample, and a pictorial installation instruction. The door jamb and claddings are shipped for field installation.

In operation, rolled metal strips are pre-cut at a cutting station. The length and the 45° angle ends are all cut by machine. Next, the width of the cladding strip is adjusted on the roller machine. Next, the cladding strip is fed into the proper input slot of the inlet port of the rolling machine. Next, a set of approximately ten rollers forms the cladding strip. Finally, small tabs are manually bent into the cladding strips as necessary.

DETAILED DESCRIPTION OF THE DRAWINGS

Figure 1:
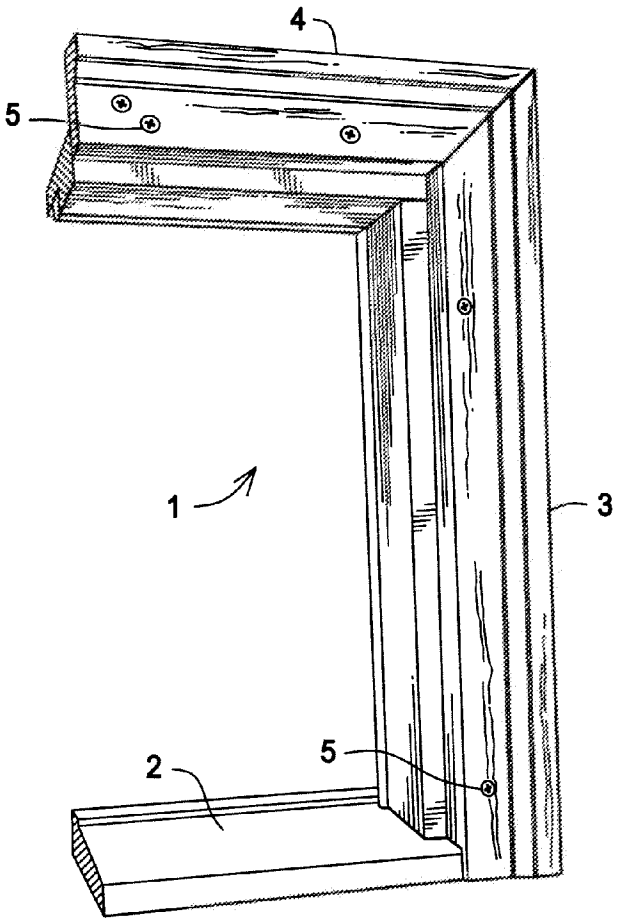
FIG.1 (PRIOR ART)
FIG. 1 is a front perspective view of a wooden door jamb.

FIG. 1 (prior art) shows a wooden door jamb 1 having a bottom plank 2, a side frame 3 and a header 4. Screws 5 are visible as viewed from the outside of the house looking at the door jamb 1.

Figure 2:
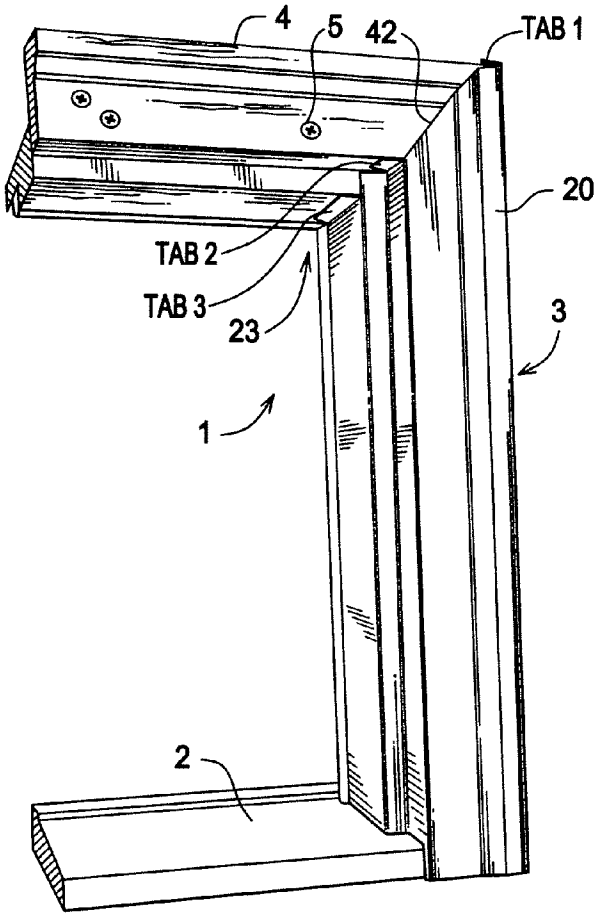
FIG. 2 is a same view as FIG. 1 with a side panel of metal cladding installed.

In FIG. 2 a cladding side 20 has been press fit onto the side frame 3 of door jamb 1. Tabs TAB1, TAB2, TAB3 of cladding side 20 have been formed to help secure the cladding side 20 to the side frame 3 as well as to help in weatherproofing the joint 23. The screws 5 in side frame 3 are now covered.

Figure 3:
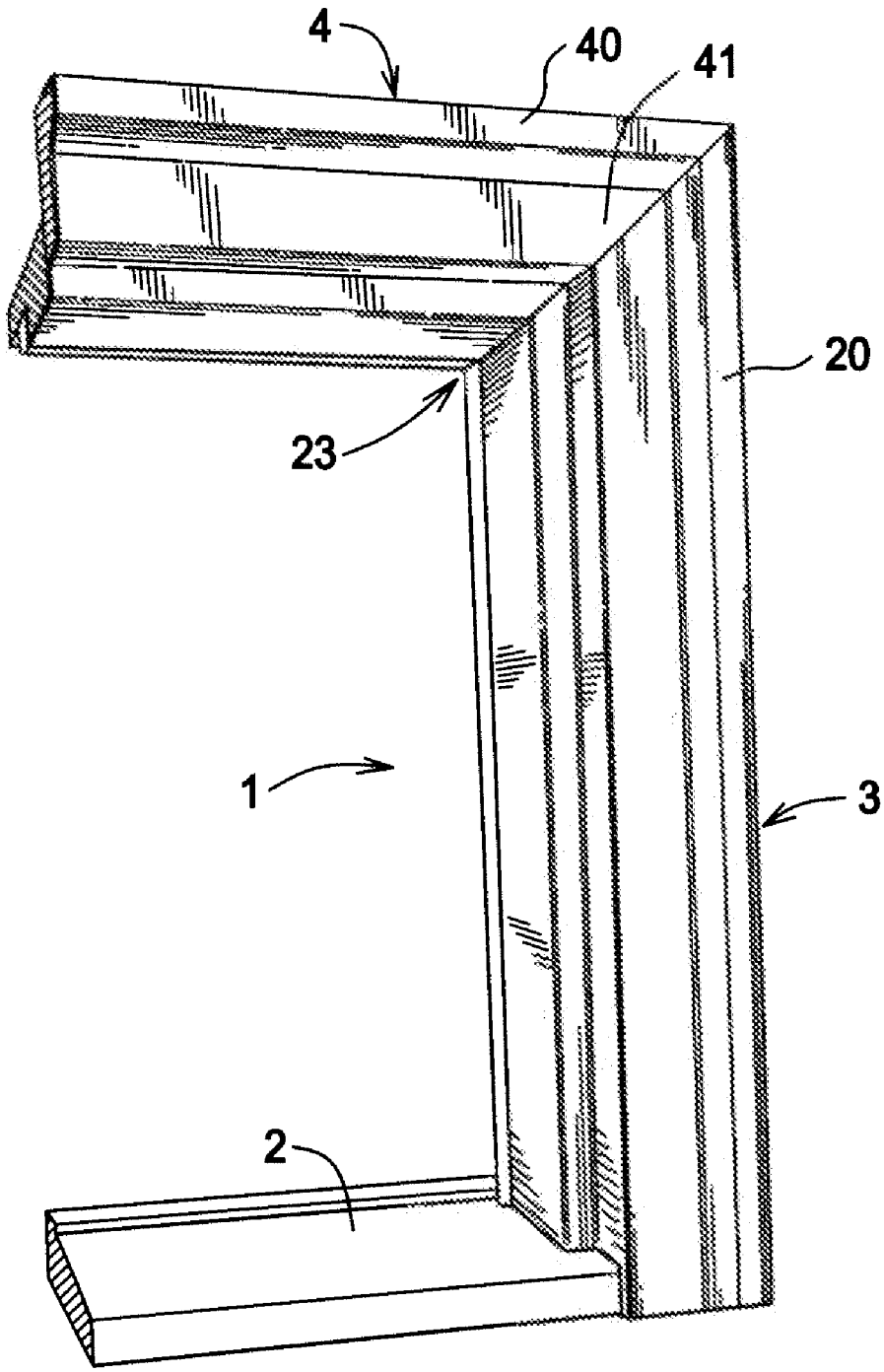
FIG. 3 is the same view as FIG. 2 with a side panel and a top panel of metal cladding installed.

In FIG. 3 the header cladding 40 has been press fit onto the header 4. Corner segment 41 provides an overlap to segment 42 of cladding 20 in FIG. 2, thereby providing weatherproof protection.

Figure 4:
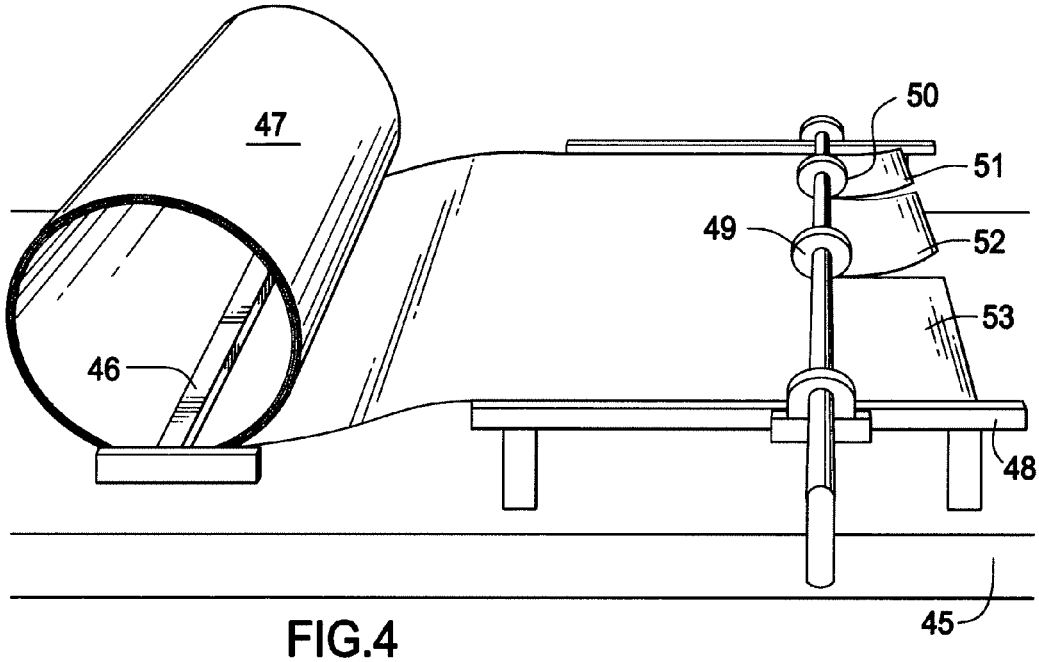
FIG. 4 is a top perspective view of the cutting operation.

The process steps to produce cladding strips 20 and 40 are disclosed below. FIG. 4 shows a cutting table 45 with a brace 46 for a roll of sheet metal 47. The roll of sheet metal 47 is fed through a guide 48 which includes adjustable slicing rollers 49 and 50. Sheet segments 51 and 52 are sized for a 2×4 door jamb and sheet segment 53 is sized for a 2×6 door jamb.

Figure 5:
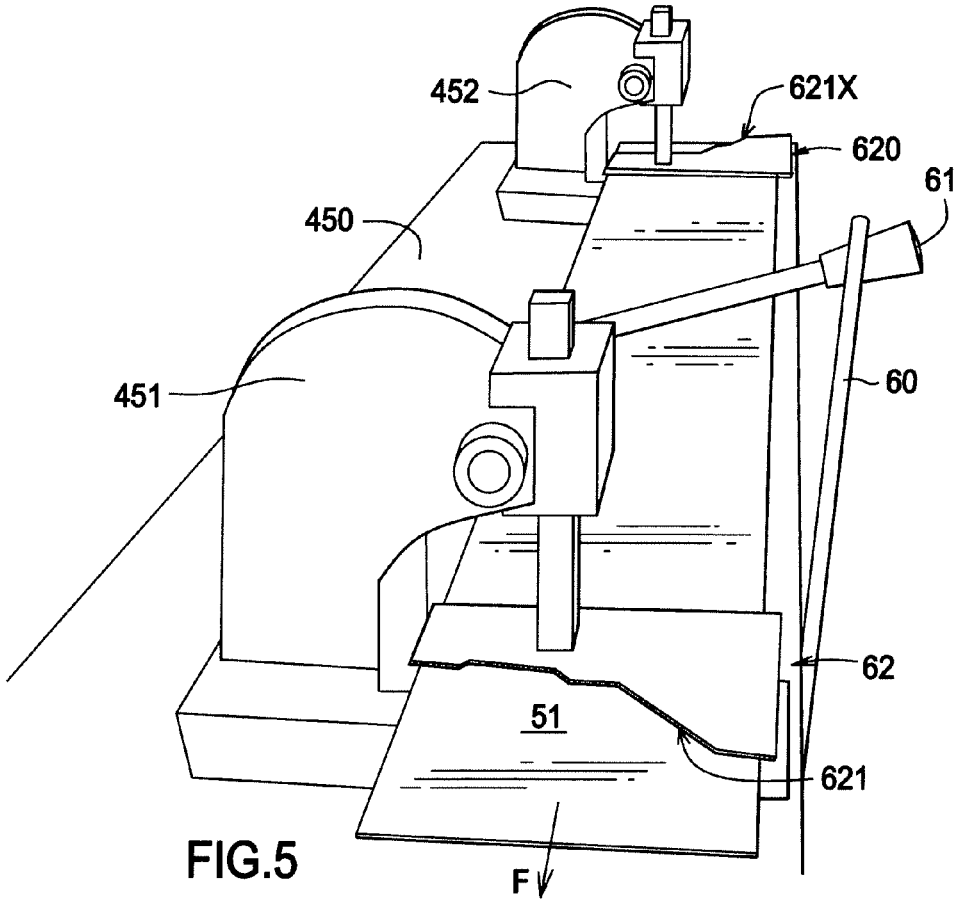
FIG. 5 is a top perspective view of the stamping operation.

In FIG. 5 a stamping table 450 may be separate from the cutting table 45. In FIG. 4 the sheet segments 51, 52, 53 are cut (nominally with electric shears) to a length for a header (about 3.5 feet) or a side cladding (about 7.0 feet), after the slitting step.

Figures 5A, 5B, 5C:
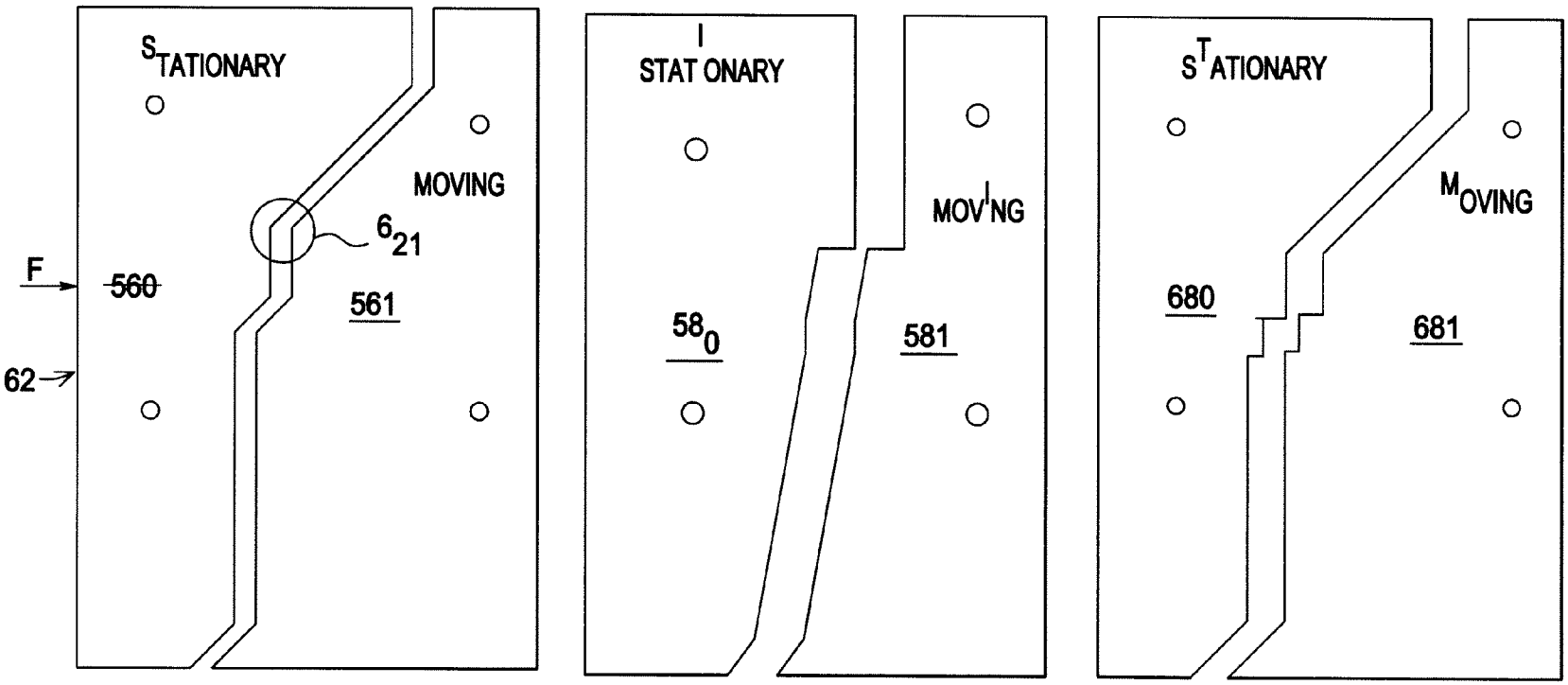
FIG. 5A is a top plan view of a stamping head.
FIG. 5B is a top plan view of a bottom side stamping head.
FIG. 5C is a top plan view of a top side stamped head.

FIG. 5A shows a setup for creating a header piece. Stamping head 62 has a stationary base 560 with moving stamping head 561 and cutting edge 621. The opposite end of the stamping table would have a mirror image 621*x* formed.

When producing side claddings, the appropriate stamping plates are placed in the stamping table 450, or a separate stamping table could be used.

The sheet segment 51 is cut at a proper header length of about 3.5 feet by stamping head 620 for a header cladding end 560, see FIG. 5A. A reverse cut 621X may be made in a mirror image of cut 621. Stamping head 62 forms the end shape at edge 561 of FIG. 5A. Stamping head 620 forms an end shape of a mirror image of 560. A pedal may activate rod 60 which then pulls lever 61 down for the stamping operation. Stamping presses 451, 452 may be mechanically or hydraulically linked in a known manner.

FIG. 5B shows a stamping head 580/581 to form a bottom edge of a side cladding. A left side is created, then the strip is flipped over to create a right in a mirror image of the left side.

In FIG. 5C the top side edge is created by stamping head 680/681. A left side is created, then the strip is flipped over to create a mirror image right side.

Figure 6:
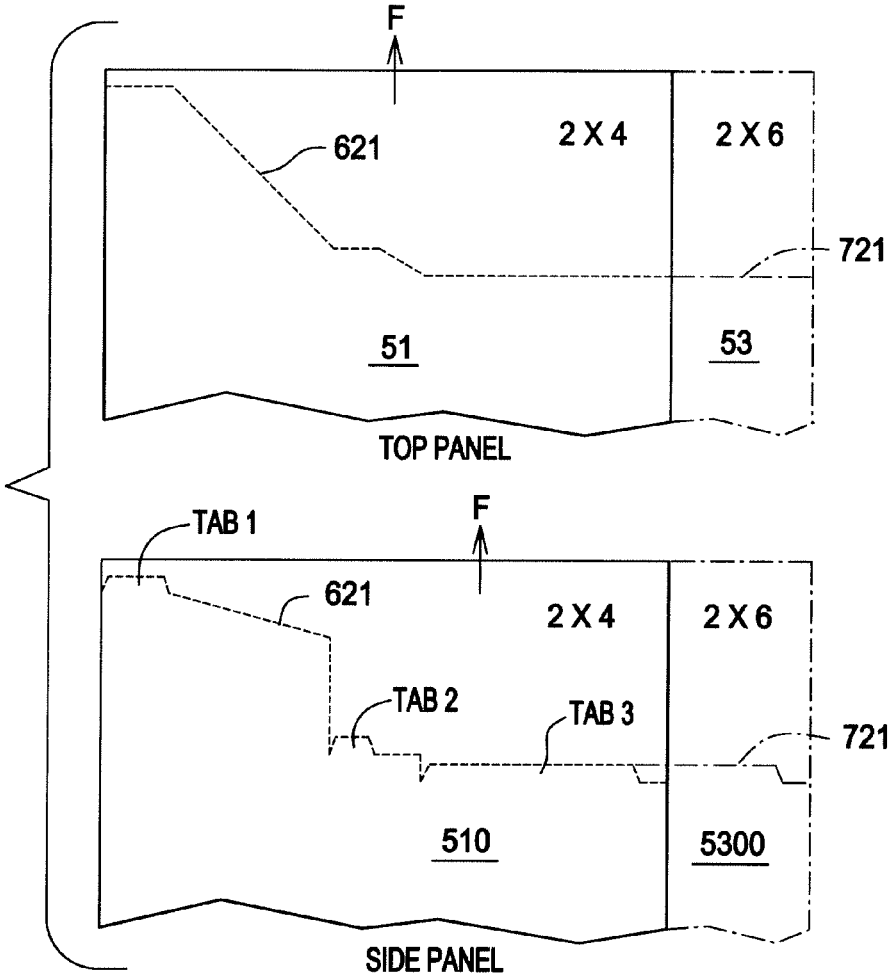
FIG. 6 is a top plan view of pre-stamped end pieces.

In FIG. 6 the narrow sheet 51, a top or header panel, is shown moving forward in direction F as in FIG. 5. The dotted line 621 matches the stamping edge outline 621 of the stamping head 62 in FIG. 5. The sheet 53 has a similar dotted line 721 for the leading edge of a wide sheet metal strip 53. The side panel, narrow sheet is labeled 510, and the wide version is labeled 5300.

Figure 7:
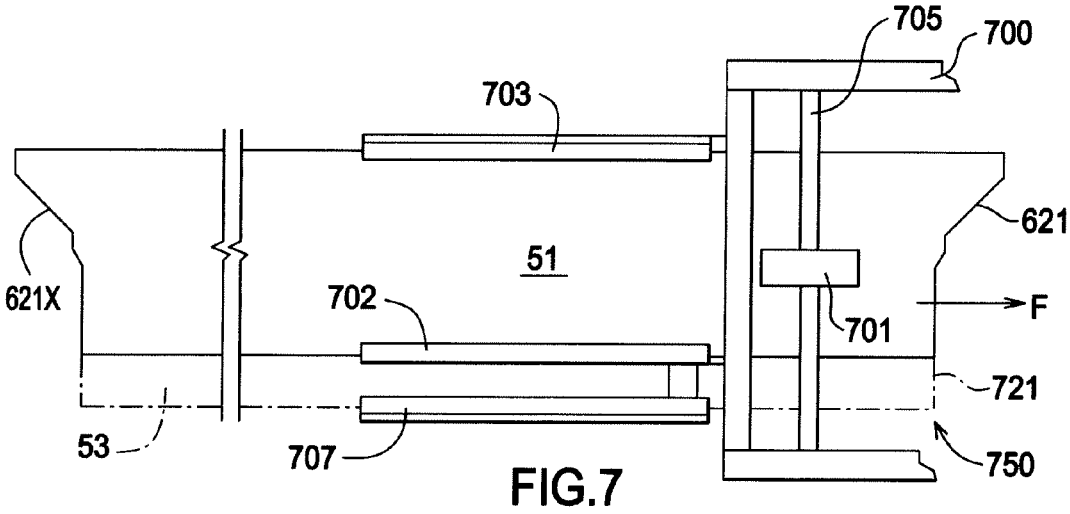
FIG. 7 is a top plan view of the feeding of a narrow die cut strip into the roller machine.

In FIG. 7 a rolling machine 750 has accepted a narrow strip 51 in a guide 703. The rolling machine feeds strip 51 in direction F. A lower set of guides 707 accept a wider strip 53 after adjustment of downstream rollers.

Figure 8:
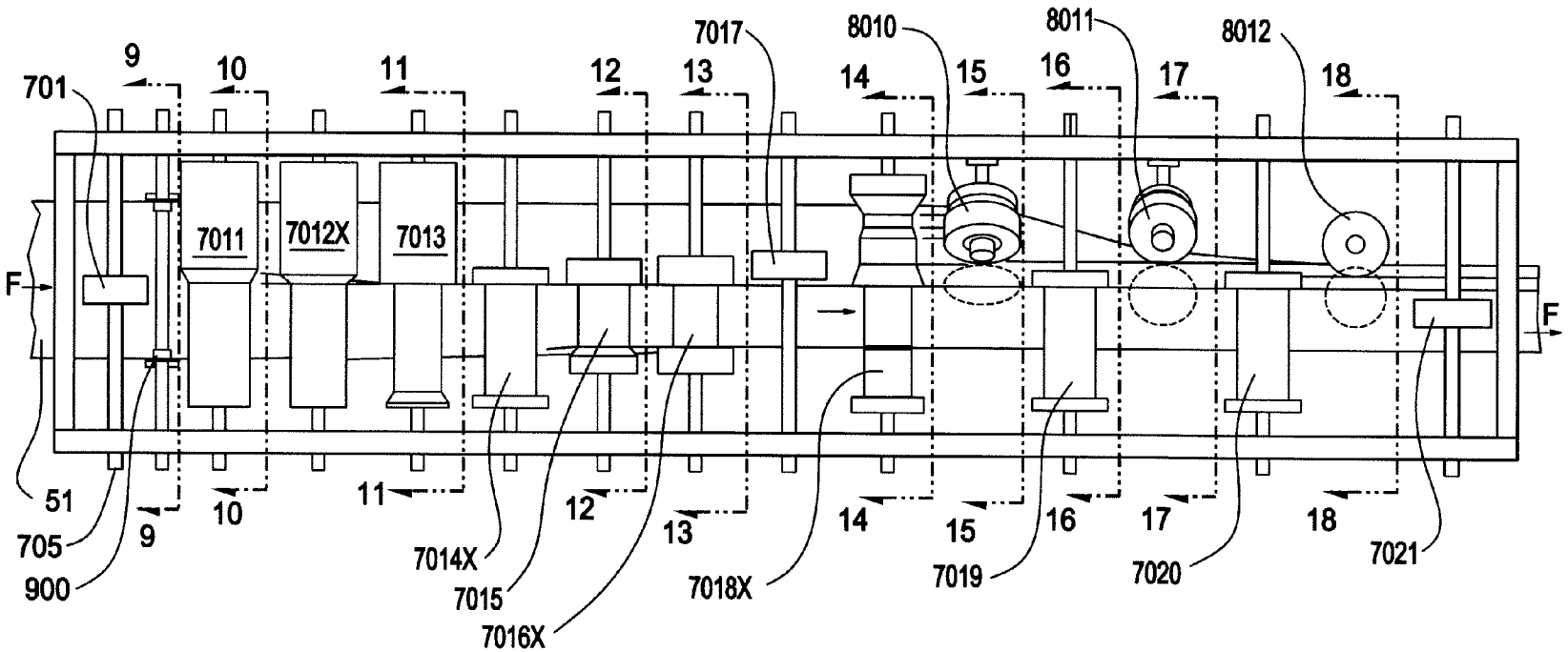
FIG. 8 is a top plan view of the roller machine in the narrow sheet mode.
Figure 33:
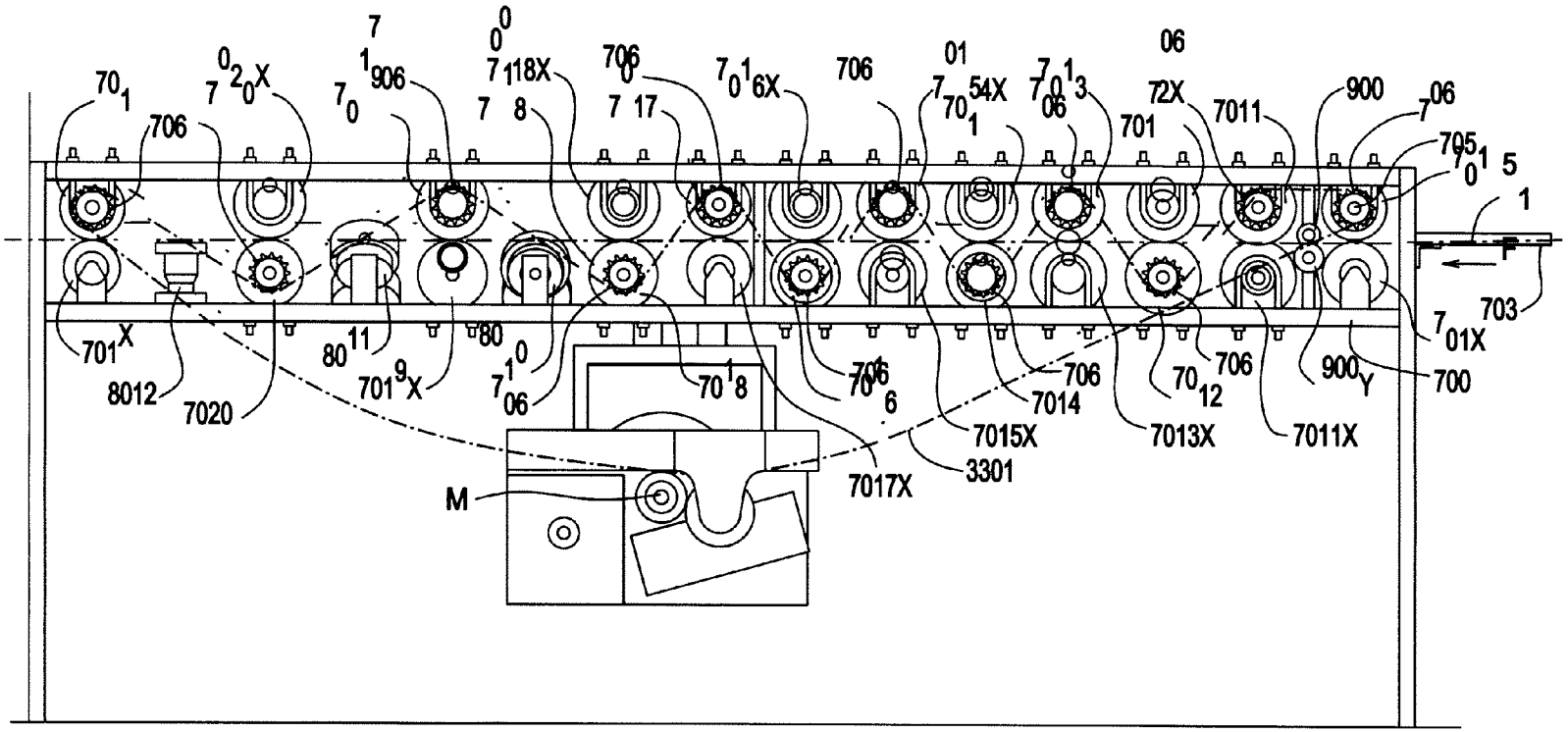
FIG. 33 is a back side plan view of the roller machine.

The rolling machine 750 has a frame 700 which supports a series of axles labeled 705. Each axle 705 supports a different roller as shown in FIG. 8. Roller 701 is a feed roller powered by a chain 3301 as shown in FIG. 33. The sprocket 706 is affixed to axle 705, thereby providing a power transmission from motor M to chain 3301 to sprocket 706 and then to roller 701.

Figure 19:
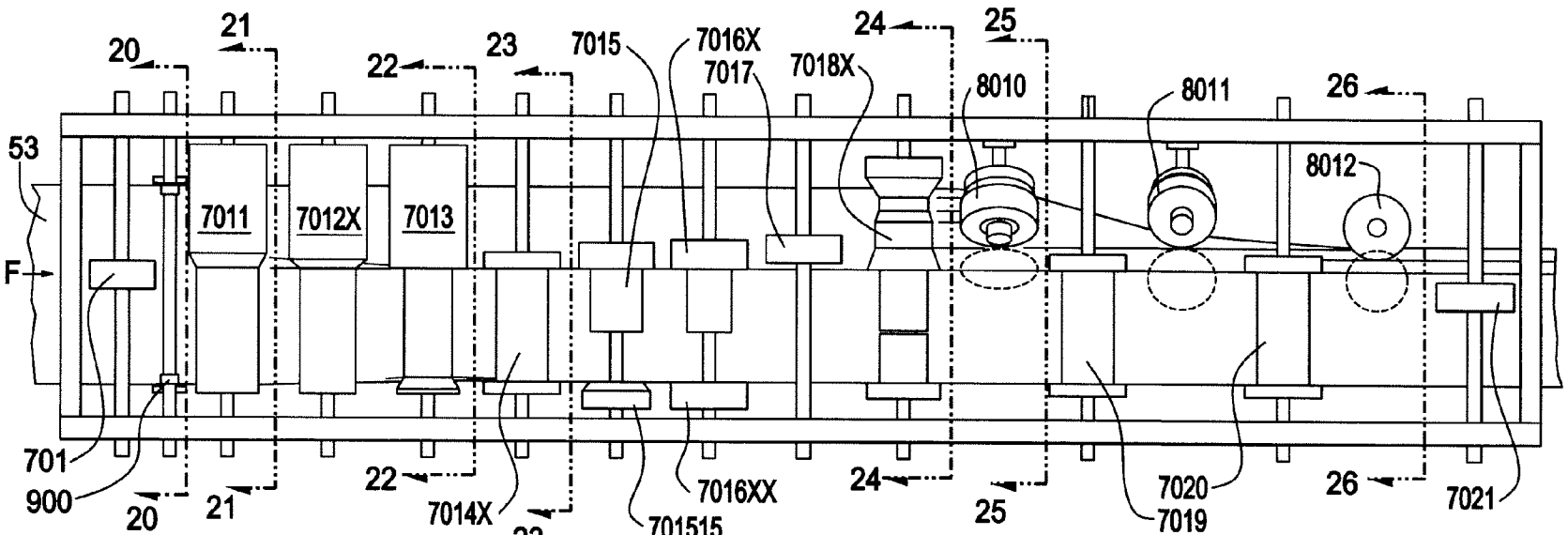
FIG. 19 is a top plan view of the roller machine in the wide sheet mode.

In FIGS. 8, 33, and 19 the power rollers are labeled 701, 7011 to 7021. Support rollers opposite a powered roller have the annotation "X" after the same numbered power roller.

Figure 9:
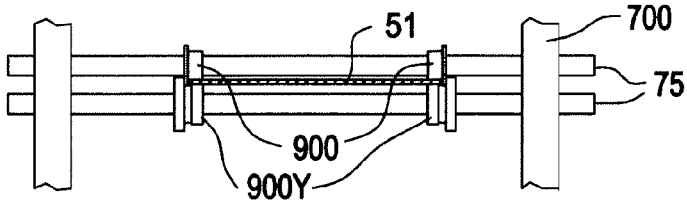
FIG. 9 is a cross sectional view taken along line 9-9 of FIG. 8.
Figure 10:
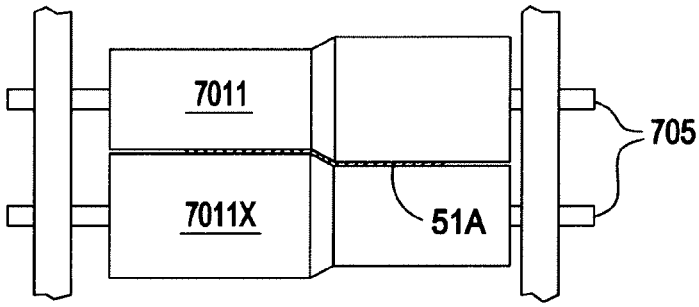
FIG. 10 is a cross sectional view taken along line 10-10 of FIG. 8.

In FIG. 9 the strip 51 has its retaining flanges formed by non-powered rollers 900 and 900Y. In FIG. 10 rollers 7011, 7011X have bent the strip to shape 51A.

Rollers 7012 and 7012*x* form the immediate bend, see FIG. 8.

Figure 11:
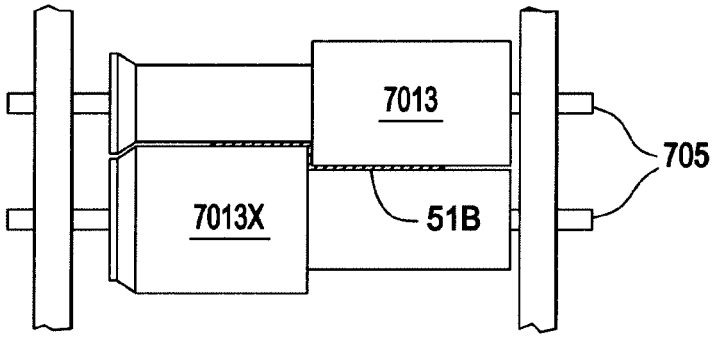
FIG. 11 is a cross sectional view taken along line 11-11 of FIG. 8.

In FIG. 11 rollers 7013, 7013X have bent the strip to shape 51B.

Rollers 7014 and 7014*x* form the intermediate bend, see FIG. 8.

Figure 12:
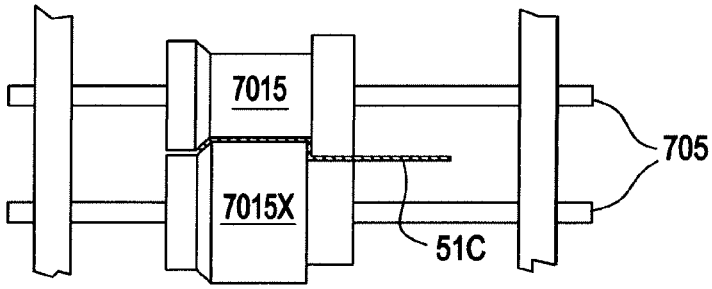
FIG. 12 is a cross sectional view taken along line 12-12 of FIG. 8.

In FIG. 12 rollers 7015, 7015X have bent the strip to shape 51*c*.

Figure 13:
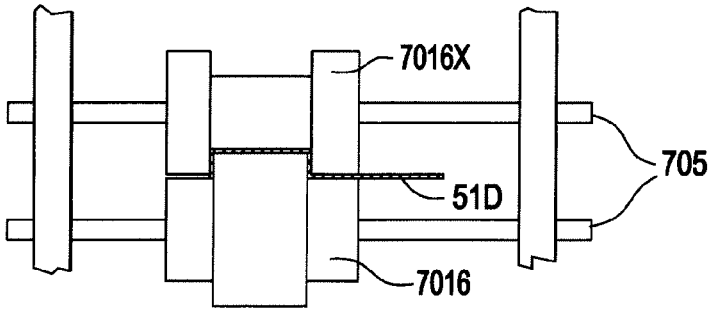
FIG. 13 is a cross sectional view taken along line 13-13 of FIG. 8.

In FIG. 13 rollers 7016, 7016X have bent the strip to shape 51D.

Figure 14:
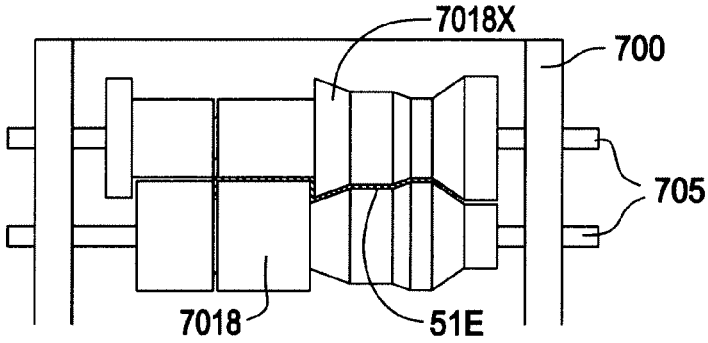
FIG. 14 is a cross sectional view taken along line 14-14 of FIG. 8.

In FIG. 14 rollers 7018, 7018X have bent the strip to shape 51E.

Figure 15:
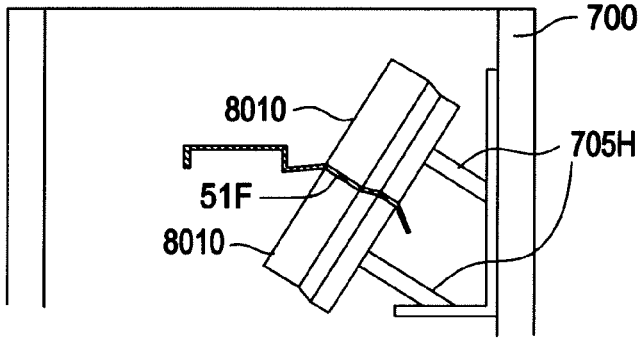
FIG. 15 is a cross sectional view taken along line 15-15 of FIG. 8.

In FIG. 15 roller pair 8010 have bent the strip to shape 51F. Axles 705H only protrude from one side of frame 700.

Figure 16:
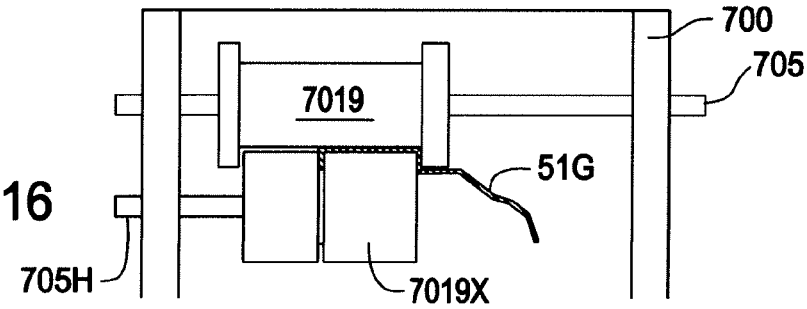
FIG. 16 is a cross sectional view taken along line 16-16 of FIG. 8.

In FIG. 16 rollers 7019, 7019X have bent the strip to shape 51G.

Figure 17:
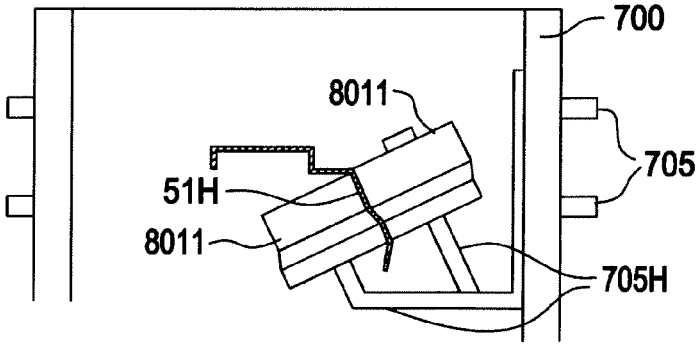
FIG. 17 is a cross sectional view taken along line 17-17 of FIG. 8.

In FIG. 17 roller pair 8011 have bent the strip to shape 51H.

Figure 18:
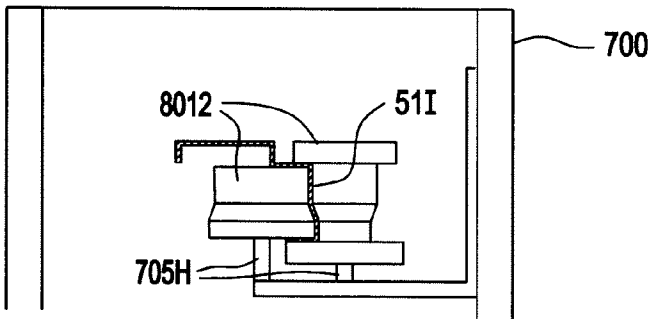
FIG. 18 is a cross sectional view taken along line 18-18 of FIG. 8.

In FIG. 18 roller pair 8012 have bent the strip to a final shape 51I.

Referring next to FIG. 19 the rolling machine 750 has been changed to the wide strip 53 mode. Rollers 7015 have been adjusted to rollers 7015 and 701515. Rollers 7016X have been adjusted to rollers 7016X and 7016XX. As shown in FIG. 7 guides 707 are used to feed sheet 53.

Figure 20:
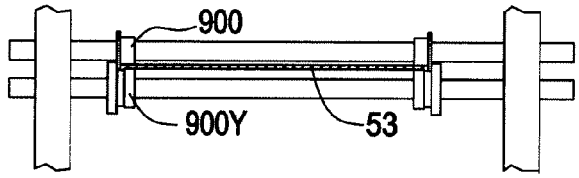
FIG. 20 is a cross sectional view taken along line 20-20 of FIG. 19.

In FIG. 20 strip 53 has its retaining flange formed by rollers 900 and 900Y.

Figure 21:
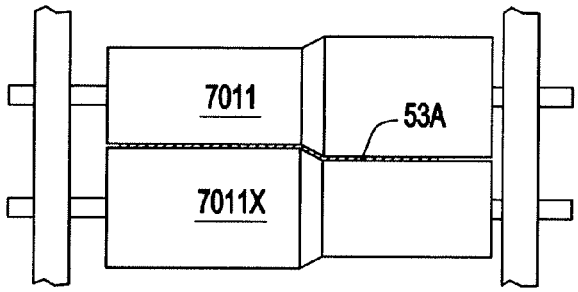
FIG. 21 is a cross sectional view taken along line 21-21 of FIG. 19.

FIG. 21 shows shape 53A.

Figure 22:
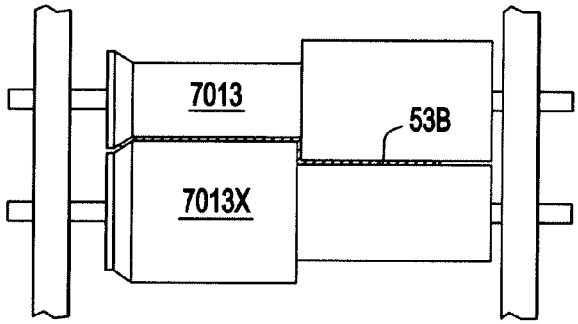
FIG. 22 is a cross sectional view taken along line 22-22 of FIG. 19.

FIG. 22 shows shape 53B.

Figure 23:
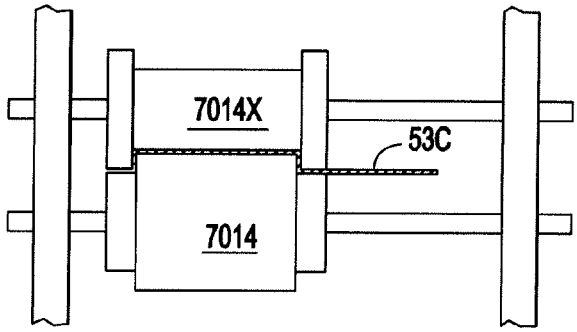
FIG. 23 is a cross sectional view taken along line 23-23 of FIG. 19.

FIG. 23 shows shape 53C.

Figure 24:
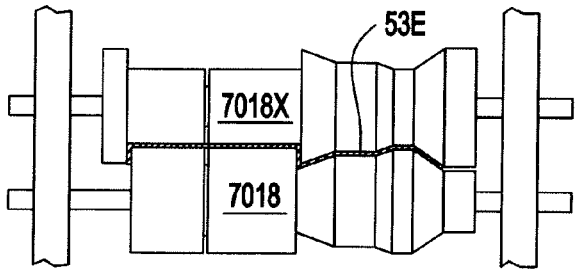
FIG. 24 is a cross sectional view taken along line 24-24 of FIG. 19.

FIG. 24 shows shape 53E.

Figure 25:
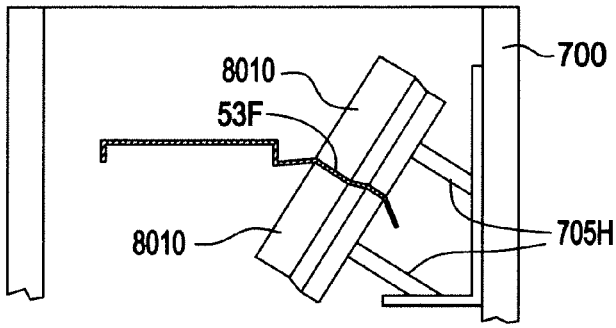
FIG. 25 is a cross sectional view taken along line 25-25 of FIG. 19.

FIG. 25 shows shape 53F.

Figure 26:
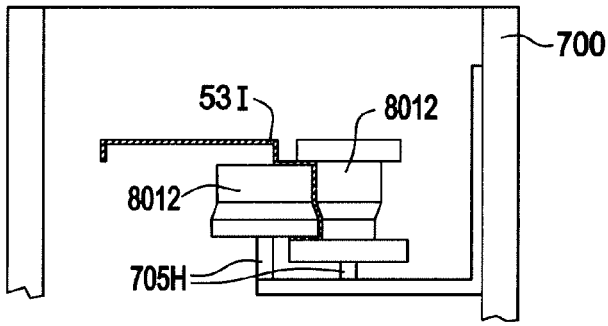
FIG. 26 is a cross sectional view taken along line 26-26 of FIG. 19.

FIG. 26 shows the final strip shape 53I.

Figure 27:
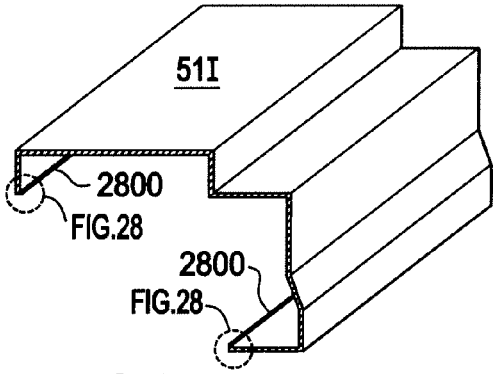
FIG. 27 is a front perspective view of a narrow sheet after processing through the roller machine.
Figure 28:
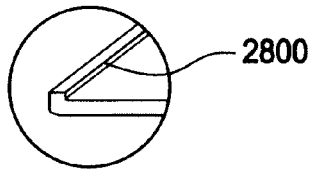
FIG. 28 is a close up view of circle 28 of FIG. 27. This is the retaining flange/burr.

In FIGS. 27, 28 a detail burr done by alignment rollers 900, 900Y of FIG. 9 is shown. The burrs are labeled 2800. Burrs 2800 assist to hold the cladding strips to the wood.

Figure 29:
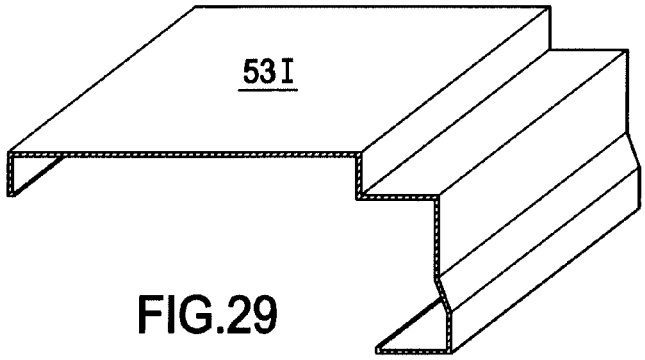
FIG. 29 is a front perspective view of a wide sheet after processing through the roller machine.
Figure 30:
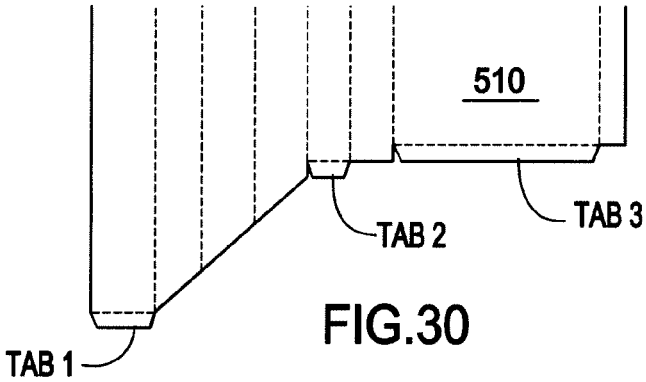
FIG. 30 is a top plan view of the tab end of a cladding piece before manual bending.
Figure 31:
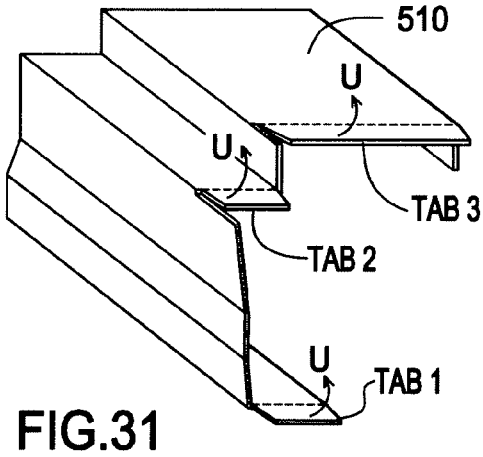
FIG. 31 is a front perspective view of the tab end shown in FIG. 30.
Figure 32:
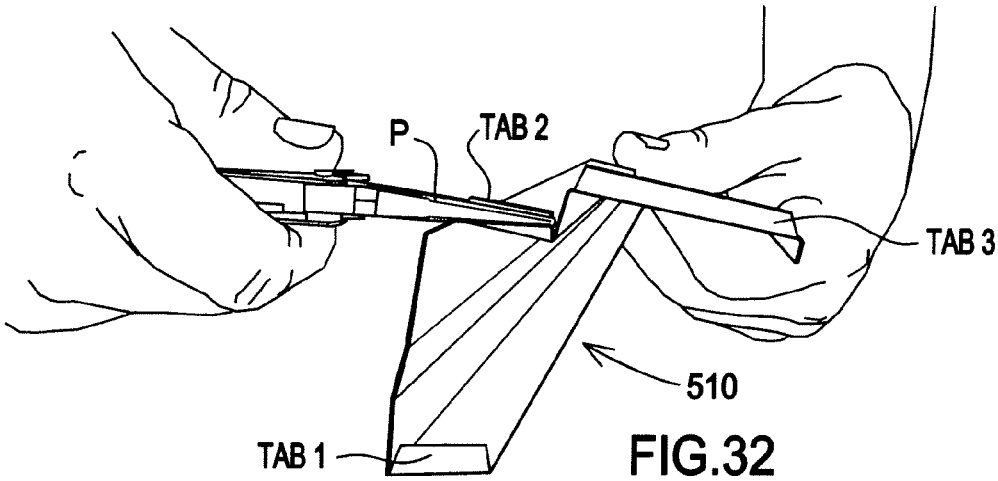
FIG. 32 is a front perspective view of the tab end with a worker bending the tabs.

FIG. 29 shows in perspective the shape 531 of FIG. 26, a final wide strip cladding.

Referring next to FIGS. 7, 30, 31, and 32 end tabs TAB1, TAB2, TAB3 are shown manually bent up in direction U by pliers P. This manual step is done last after all the rolling machine bending operations.

Figure 34:
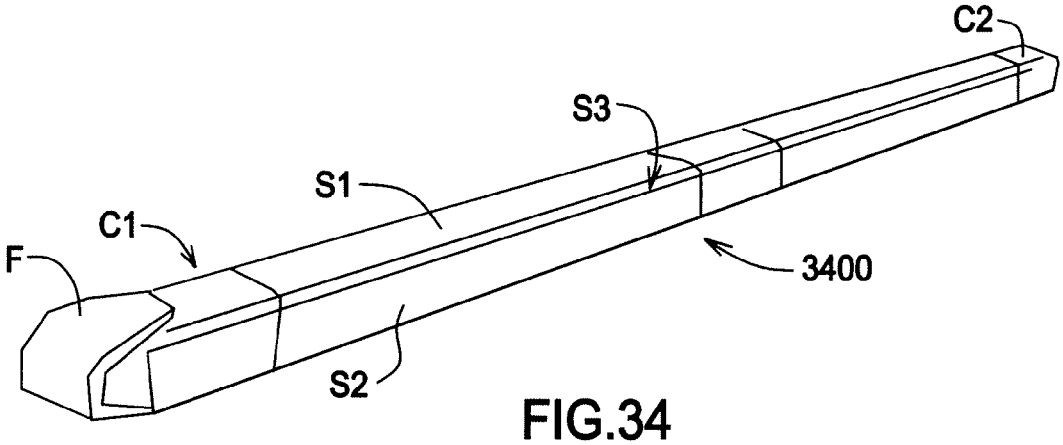
FIG. 34 is a side perspective view of a finished cladding assembly ready for shipping.
Figure 35:
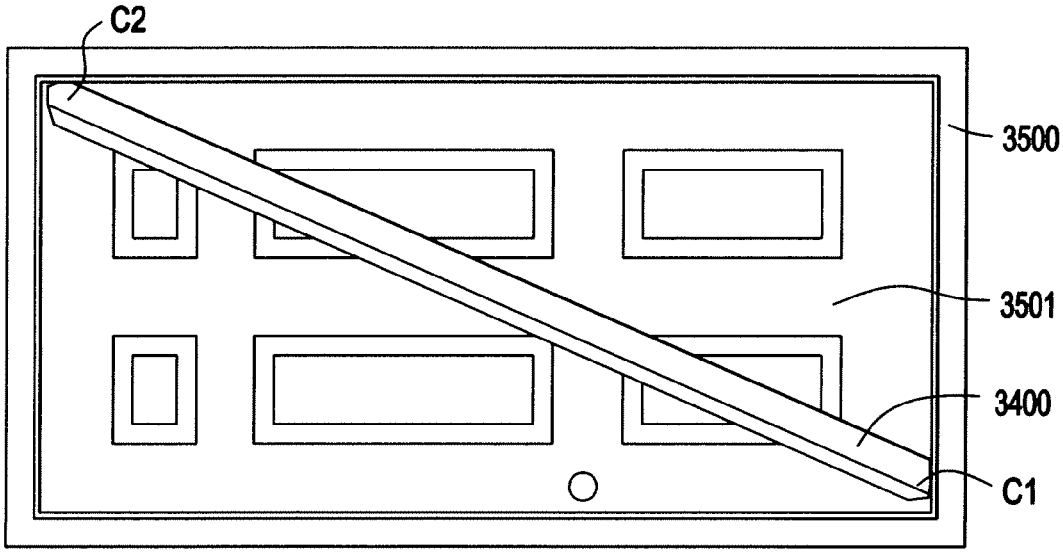
FIG. 35 is a front plan view of a door jamb and cladding assembly ready for shipping.

Referring to FIGS. 34, 35 a packaging process is shown. Side cladding members S1, S2 sandwich a header cladding member S3 in between to form a rectangular container 3400. Cardboard ends C1, C2 secure the container 3400 into one piece. Container is secured via stapling flap F at end C1 and C2 to the door jamb 3500 against the door 3501. The assembly 3500, 3501, 3400 is shipped as a single unit.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A method to produce a metal cladding strip suited to be manually pressed onto a frame member of a door jamb, the method comprising the steps of:

a) cutting a sheet metal strip from an unbent sheet of sheet metal into at least two different width strips, A and B;

b) cutting each strip into a desired length;

c) forming an angular end shape at both ends of each strip to become a header or a side member for the metal cladding strip;

d) feeding the precut and preformed angular end shape strip A into a rolling machine upper inlet guide;

e) powering at least two rollers in the rolling machine to transport the strip A through a plurality of opposing pairs of rollers;

f) forming at least four bends in the strip A with the plurality of opposing pairs of rollers, thereby creating a first metal cladding strip;

g) bending a tab into the strip A at the end shape to complete a cladding member;

h) using at least one set of opposing rollers to form at least one burr along a longitudinal edge of the metal cladding strip formed from strip A;

i) providing an upper and lower inlet guide on the rolling machine, each at a different height;

j) forming a header piece and a left and a right side member into a door jamb set by repeating steps c thru i;

k) adjusting at least one moveable roller to accommodate a different width of strip B without removing any rollers;

l) feeding a precut and preformed angular end shape of strip B into the lower inlet guide; and m) repeating steps e thru j for strip B.

* * * * *